United States Patent [19]

Smith

[11] 4,057,192

[45] Nov. 8, 1977

[54] TREE HARVESTING MACHINE

[75] Inventor: Leward N. Smith, Remus, Mich.

[73] Assignee: Morbark Industries, Inc., Winn, Mich.

[21] Appl. No.: 582,429

[22] Filed: June 2, 1975

[51] Int. Cl.[2] ..... B02C 18/08

[52] U.S. Cl. ..... 241/92; 144/176; 144/246 C; 144/246 F; 241/223; 241/281; 241/298

[58] Field of Search ..... 241/92, 101.7, 223, 241/278 R, 281, 298; 144/162 R, 176, 246 L, 246 F

[56] References Cited

U.S. PATENT DOCUMENTS

| | | | |
|---|---|---|---|
| 3,144,995 | 8/1964 | Fontaine | 241/298 |
| 3,289,719 | 12/1966 | Gunn | 144/176 X |
| 3,542,302 | 11/1970 | Salzmann | 144/176 X |
| 3,661,333 | 5/1972 | Smith | 241/281 |
| 3,844,489 | 10/1974 | Strong | 241/92 X |
| 3,905,558 | 9/1975 | Gaitten | 241/92 X |

*Primary Examiner*—Roy Lake
*Assistant Examiner*—Howard N. Goldberg
*Attorney, Agent, or Firm*—Learman & McCulloch

[57] ABSTRACT

Machinery for reducing forest products to wood chips wherein a bed conveyor, a powered roll mounted for vertical movement above the bed conveyor, and powered, generally vertical side roll means downstream of the generally horizontal roll, feed a tree or log to a chipper disc. The chipper disc has at least one opening, and a knife positioned at the opening to cut products conveyed to the disc into chips and propel them through the opening with rotation of the disc assembly. The machine includes improvements which are more specifically set forth in the following material.

8 Claims, 7 Drawing Figures

TREE HARVESTING MACHINE

FIELD OF THE INVENTION

This invention relates to wood chipping machinery for use in the forest products industry to reduce whole trees and parts thereof to wood chips, and more particularly to certain useful and novel improvements in such machinery. Prior art patents of which applicant is aware include the following U.S. pat. Nos.

| | |
|---|---|
| 2,392,958 | 2,936,008 |
| 2,594,583 | 3,173,618 |
| 2,663,506 | 3,346,027 |
| 2,679,873 | 3,661,333 |
| 2,848,029 | 3,817,027 |
| | 3,861,602 |

BACKGROUND OF THE INVENTION

Machinery of this character has been provided in the past and attention is particularly directed to applicant's assignees U.S. Pat. No. 3,661,333. The present application is directed to certain new and useful improvements which render such machines more economical to produce, and improve it in certain important respects.

Machinery in accordance with the patent mentioned, which I hereby incorporate by reference, has been well accepted by the forest products industry and presently is in wide use in the United States of America to reduce entire trees of various varieties to wood fiber chips which can be readily processed to make a large variety of products. Such machinery is proving extremely valuable to harvest trees in a manner to harvest large tracts of land while leaving sufficient trees in place for future harvesting.

One of the prime objects of the present invention is to provide a new chipper disc of unique configuration which offers a considerable number of advantages over the conventional circular chipper disc in prior usage. For example, a new disc, which has a knife mounting part of generally triangular configuration is considerably lighter in weight than conventional discs, and this enables it to be more easily transported, and reduces clutch problems by lessening the starting load. Furthermore, the new disc of unique design makes a quicker r.p.m. recover and there is a considerable reduction in rim stress. As a result, the new chipper disc will chip faster and more efficiently.

Still another object of the present invention is to provide a tree chipping machine of the character described wherein the chipper disc assembly includes chip collecting housings which travel with the chipper disc and avoid the tremendous wear problems which have occurred in prior art machines, wherein the chips travel through the chipper disc, once cut, and impinge against the rear stationary wall of the chipper disc housing. The present chip collecting housings are of increasing girth or volume to avoid any wedging of masses of chips in the housing, and the apparatus is capable of operation at slower speeds than formerly without deleterious effect.

Still a further object of the invention is to provide forest products harvesting machinery of the character mentioned wherein mechanism is provided for partially revolving trees with forked trunks being fed to the chipper disc opening to permit the opening to accommodate trees having crotches, which would in unrotated position, not be able to pass through the chipper housing opening.

Still another object of the invention is to significantly improve the machine of the prior art, while at the same time making such machines more economical to manufacture and acquire, without in any way reducing effectiveness or reliability.

Other objects and advantages of the present invention will become apparent to those of ordinary skill in the art as the description thereof proceeds.

SUMMARY OF THE INVENTION

Machinery for reducing whole trees and parts thereof to wood chips wherein a live feed bed, a vertically adjustable, generally horizontal, powered roller positioned thereabove, and generally vertical powered side roll means feed a tree to a knived chipper disc. One improvement is concerned with the provision of chip collecting and releasing housings of outwardly increasing girth on the rear face of the disc assembly to rotate therewith. Other improvements are concerned with the provision of tree rotating means at the mouth of the chipper opening, and the construction of the chipper disc and live feed bed.

The present invention may be more readily described by reference to the accompanying drawings wherein.

Figure 1:
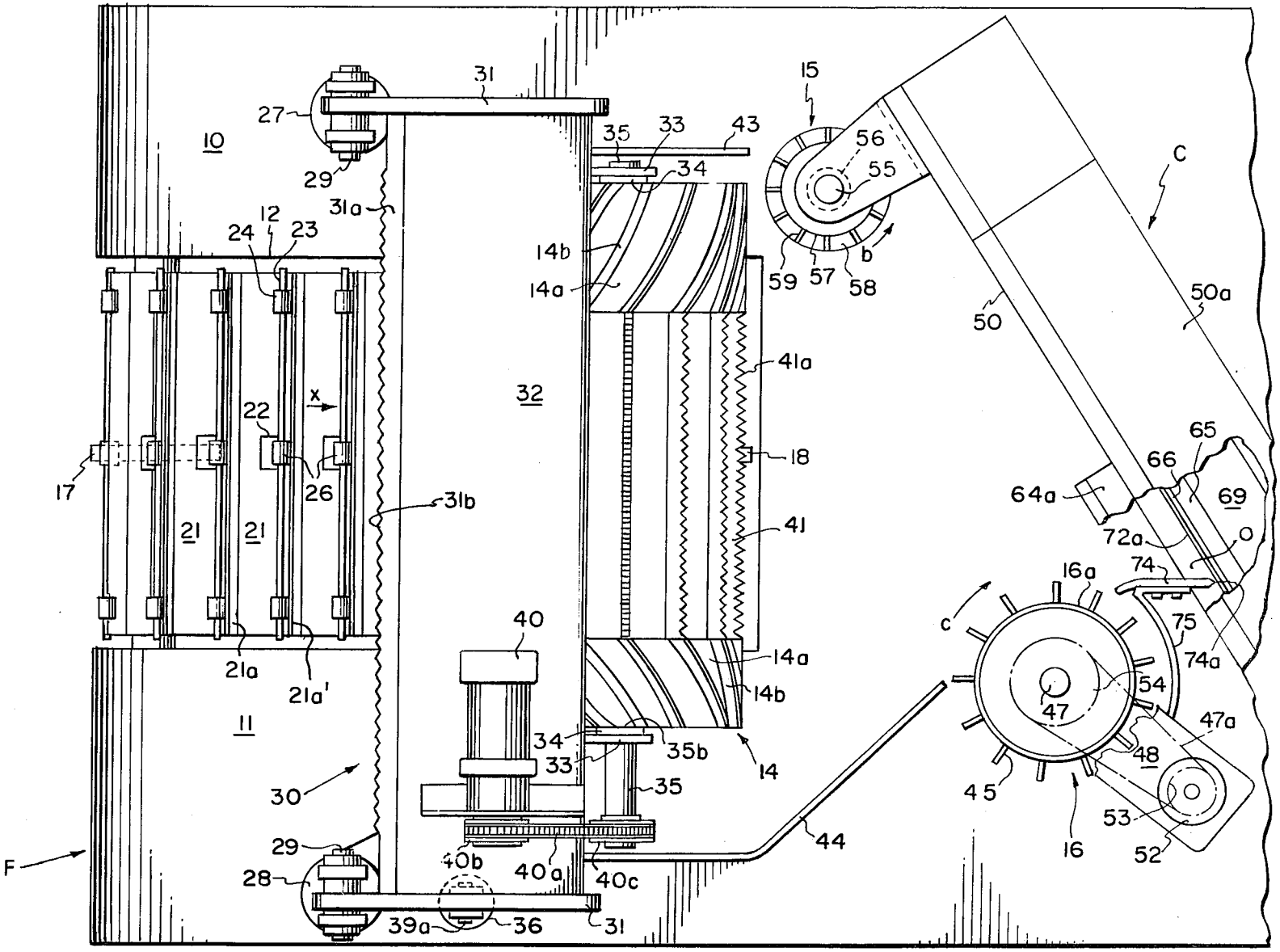
FIG. 1 is a top plan view of the machine, part of the chipping disc assembly being broken away as shown for purposes of clarity.
Figure 2:
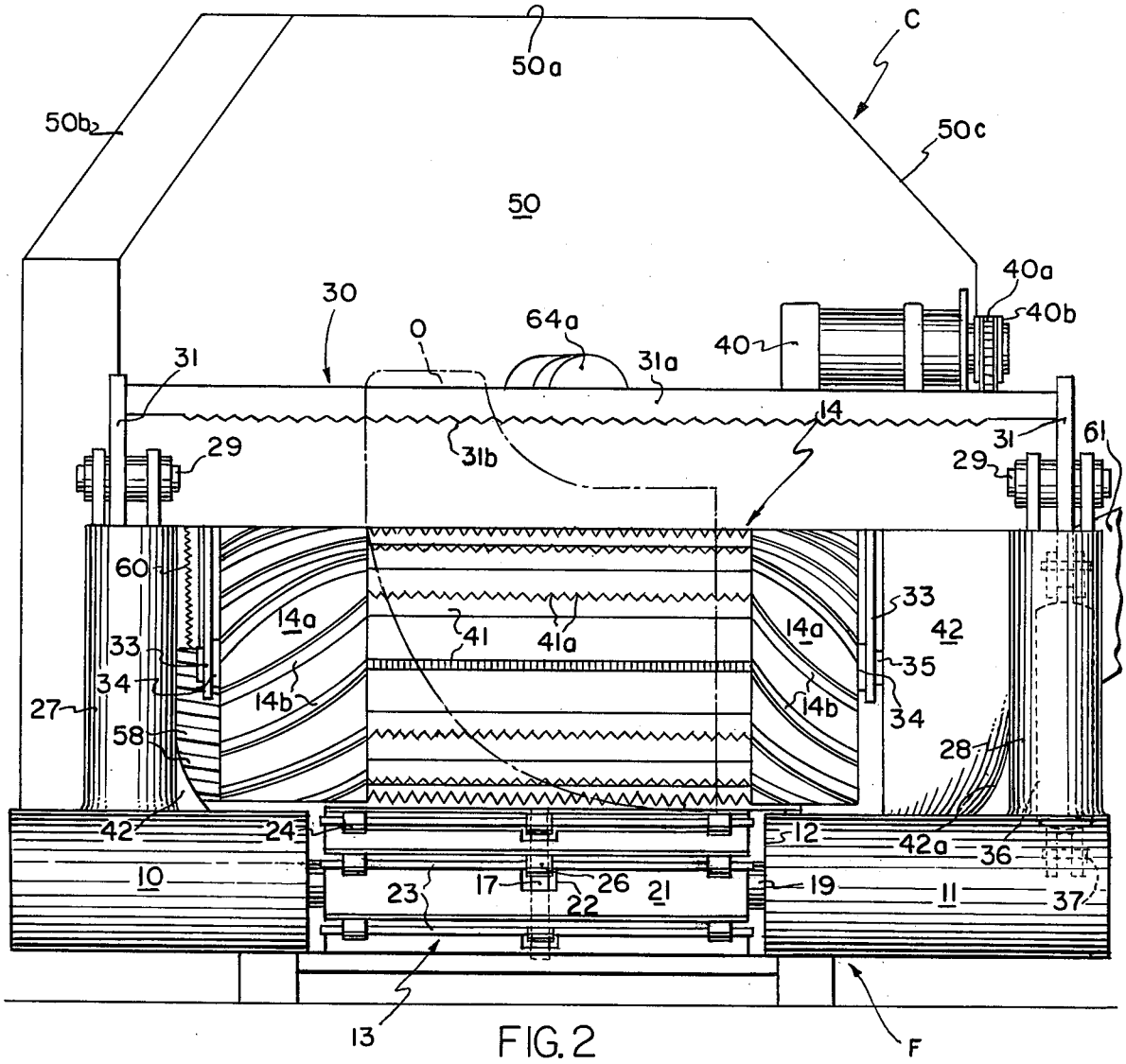
FIG. 2 is a front elevational view thereof, taken from the charge or rear end of the machine, the chain lines indicating the feed opening in the front of the chipper housing.
Figure 3:
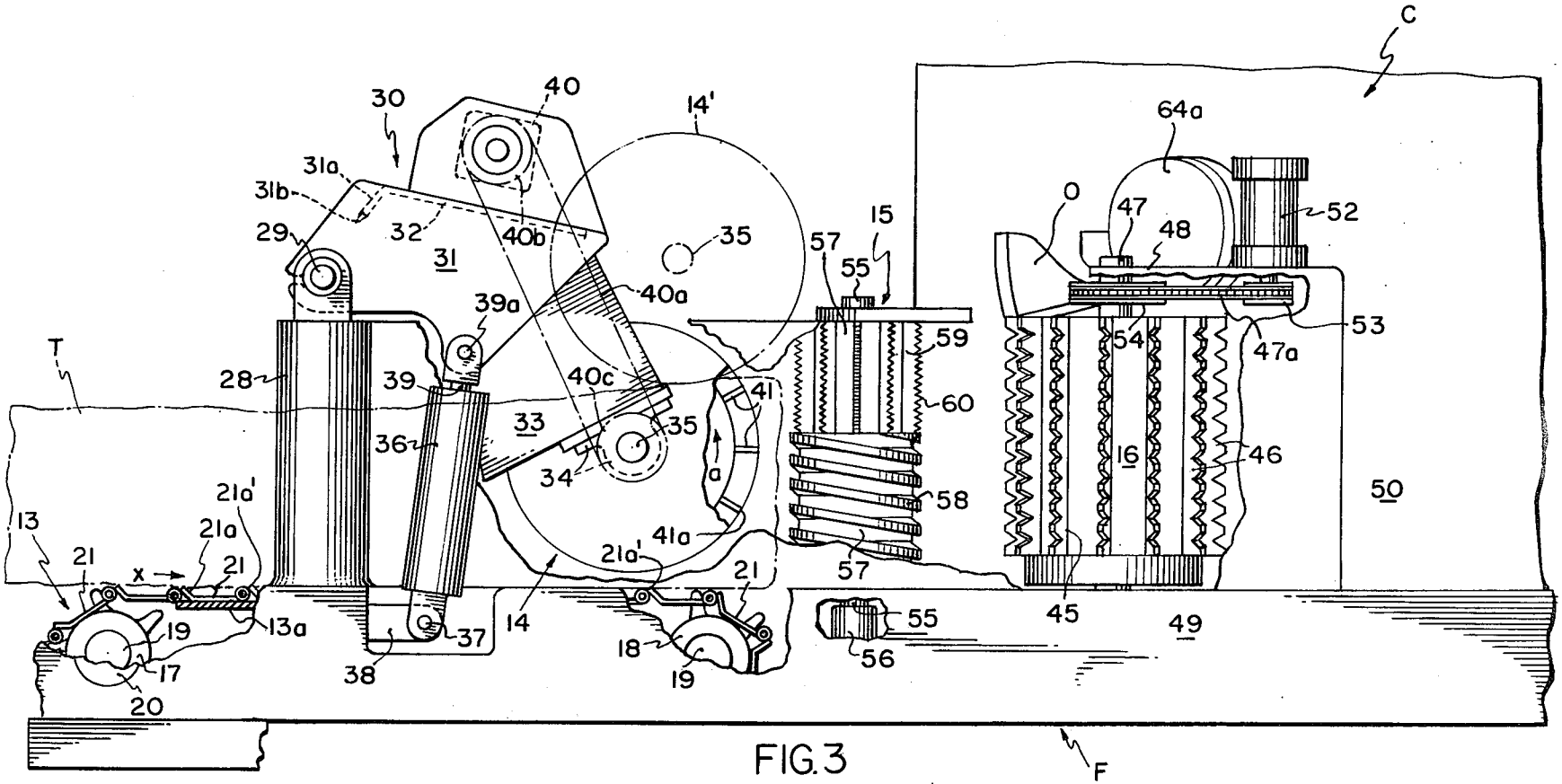
FIG. 3 is a side elevational view of the machine with portions partly broken away to illustrate the construction thereof, the chain lines illustrating a raised position of the top roll.

Referring now more particularly to the accompanying drawings and in the first instance to FIGS. 1, 2 and 3, my machine is shown as comprising a frame, generally designated F, which may include the bed of a trailer and be mounted on wheels in the manner of the machine is disclosed in U.S. Pat. No. 3,661,333. The frame includes side bed portions 10 and 11, defined by a recess 12 which is open to accommodate a "live" conveyor bed, generally designated 13. The "live" bed comprises an endless conveyor, having an upper run which, as FIG. 3 indicates, proceeds at the level of the bed portions 10 and 11 along a guide 13*a* and is driven in the direction *x* (see FIG. 3), to deliver trees being processed toward a chipping disc housing, generally designated C (see FIG. 1) which is angularly disposed relative to conveyor 13.

Provided to assist the "live" bed 13 in moving a tree T being processed to the chipping assembly C, are a vertically movable, horizontal roll, generally designated 14, which is crosswisely disposed to conveyor 13, and a pair of vertically disposed side rolls generally designated 15 and 16. The roll members 14, 15, and 16, which later will be described in more detail, are driven at coordinated tree advancing speeds in correlation with the conveyor 13, in the direction of arrows *a, b* and *c*, respectively.

The "live" bed conveyor 13 is shown as comprising an endless member trained around front and rear sprockets 17 and 18, respectively, which are fixed on shafts 19, supported in the usual bearing housed in frame parts 10 and 11. One of the shafts 19 is driven by a conventional rotary hydraulic motor 20.

The conveyor 13 comprises a series of connected elongate plates 21, each having central sprocket teeth receiving openings 22 (FIGS. 1 and 2) provided in the leading edges thereof. Pins 23 welded to the leading ends of each plate 21, and journaling sleeves 24 and 26 welded at the trailing upturned ends 21*a* of each plate 21, provide a pivotal connection between the conveyor plates 21. The upturned edges 21*a'* tend to bite into trees being carried on the conveyor 13 as the trees are forced down on conveyor 13 by the pressure of top roll 14, while still permitting trees to readily move laterally to centered position.

Provided on the frame portions 10 and 11 are upstanding support and tree guide posts 27 and 28 and pivotally mounted on pins 29 on the posts 27 and 28 is a top roll support frame, generally designated 30. The frame 30 includes side plates 31 connected by a top wall 32 which supports dependent plates 33, on which are mounted bearings 34 for the drive shaft 35 of top roll 14. A hydraulic cylinder 36, pivotally connected at 37 with a support arm 38 provided on frame F, has a piston rod 39 pivotally connected at 39*a* with one of the side plates 31 and is operable to raise and lower the roll support assembly 30 about pivot pin 29 to raise and lower horizontal roll 14 between the lowermost solid line position shown in FIG. 3, and the uppermost raised position shown in chain lines in FIG. 3 at 14'.

The shaft 35, which is fixed to the roll 14 at 35*b* may be powered by a rotary hydraulic motor 40, via a drive chain 40*a* and sprockets 40*b* and 40*c* on the output shaft of motor 40 and shaft 35, respectively. As in U.S. Pat. No. 3,661,333, the drum 14*a* of the roll 14 is provided with spiral vanes 14*b* at its ends to tend to move a tree being conveyed laterally centrally on conveyor 13, and with circumferentially spaced bars 41 providing rows of tree surface engaging teeth 41*a*. Converging vertical side wall guides 42, which are curved at their lower ends as at 42*a*, extend forwardly from posts 27 and 28 for a distance and vertical side guides 43 and 44 are also provided to tend to confine the branches and limbs of the tree moving forwardly toward the chipper housing C.

The rear wall 31*a* of the roll mount structure 30 is provided with a series of projecting teeth 31*b* for the purpose of providing a grip or purchase on the tree when the loader arms are loading a tree T onto conveyor 13. The teeth 13*b* will bite into the end of a tree being loaded trunk foremost and aid the crane operator in his task of moving the tree into operative relationship with the feeding devices.

The roll 16, which has a drum 16*a* with a series of circumferentially spaced bars 45 which are serrated as at 46 to provide tree engaging and grasping teeth, is mounted for rotation about a vertical axis on a shaft 47, which may be suitably journaled via bearings provided on frame supports 48 and 49. The roll 16 is provided to project inboard of the end of roll 14 adjacent one side of the mouth of the opening O (FIG. 2) in the rear wall 50 of the angularly disposed chipper housing C. A rotary hydraulic motor 52 may be provided for driving the shaft 47 via a chain 47*a* trained around sprockets 53 and 54 on the motor 52 output shaft and on the shaft 47, respectively. At the opposite side of the machine, and adjacent to the horizontal roll 14, vertically disposed roll 15 is mounted to project laterally inboard of the end of roll 14 for rotation about a vertically disposed shaft 55. Shaft 55 is journaled by suitable bearings provided on frame F and is also driven by a suitable hydraulic motor 56 connected to the lower end of shaft 55 in any suitable manner. The roll 15 includes a part drum 57, which mounts helical vanes 58 extending upwardly about half the height of drum 57 for a purpose which later will be described in detail. The upper portion of drum 57 mounts circumferentially spaced vertical bars 59 which are serrated to form tree engaging teeth as at 60.

The chipper housing C includes, in addition to the rear wall 50, top wall 50*a*, angular side walls 50*b* and 50*c*, and a curvilinear lower wall or belly-band 50*d* extending to a chute 61 out which the chips cut are expressed. There is in addition, a forward wall 62, and a lower housing portion 63. The chipper housing is provided with a drive shaft 64, preferably driven via a Diesel engine in the manner described in the aforementioned patent in a suitable manner. Mounted on shaft 64, on the front face of an enlarged hub part 64*a* which projects rearwardly through wall 50, is a generally triangular-shaped knife mounting disc part generally designated 65 having a series of circumferentially spaced openings 65*a* provided therein. In the present instance, three such openings are shown and the chipper depicted is a three-blade chipper. It should be understood, however, that a fewer or greater number of knives may be provided to fit the particular operation to be performed.

The generally triangular-shaped knife mounting part 65 is relatively thick and heavy, compared with circular disc wear segments 66 which are secured to it by way of bolt member 67. Thus, while the composite disc is circular in character, it is made up of the relatively heavy knive mounting part 65 and much lighter circular segments 66, which include an outer circular edge 66*a*, an inner circular edge 66*b*, and side edges 66*c*, which adjoin the knife openings 65*a*. When two or four knives 72 are to be used, the knife mounting part 65 is square rather than triangular and four 90° wear plates 66 are used instead of three.

Figure 5:
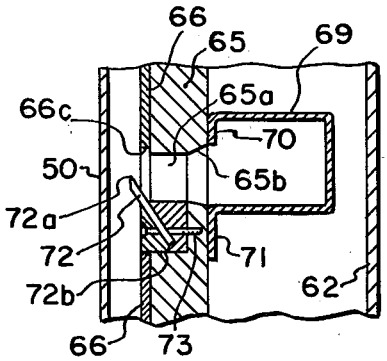
FIG. 5 is a fragmentary, sectional view taken on the line 5—5 of FIG. 4.
Figure 7:
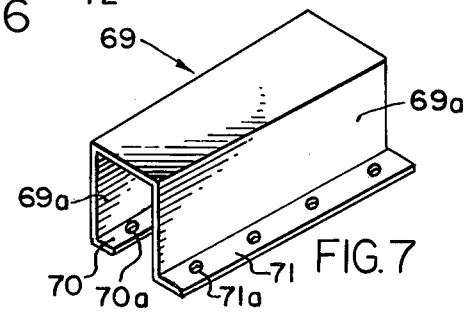
FIG. 7 is a perspective view illustrating the configuration of one of the chip collecting housings which secure to the rear of the chipper disc assembly.

As FIG. 5 particularly indicates, each knife opening 65*a* is flared at its front end as at 65*b*, adjacent a chip collecting housing 69 which secures to the rear face of disc part 65. The housings 69 which are open at both ends include flanges 70 and 71 with opening 70*a* and 71*a* which permit them to be readily bolted to the disc part 65. It is important to understand that the generally U-shaped housings 69 are of constantly increasing girth, insofar as diverging side walls 69*a* are concerned, from the inner end thereof disposed adjacent to shaft 64 to the outer end thereof which extends slightly beyond the periphery or perimeter of segments 66 and disc part 65.

Figure 4:
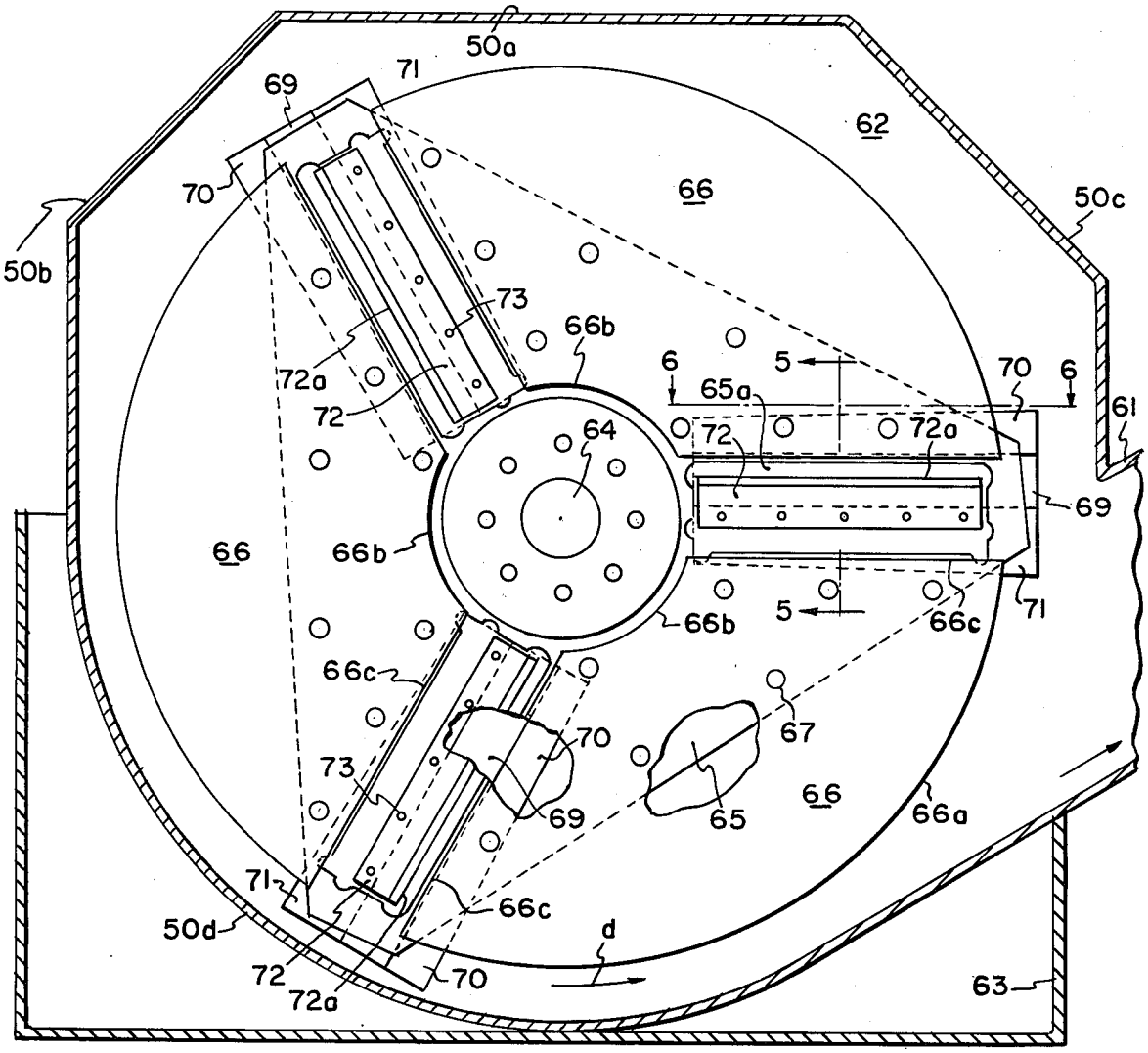
FIG. 4 is a transverse sectional view through the chipper disc housing, showing the face of the chipper disc and illustrating the construction thereof.
Figure 6:
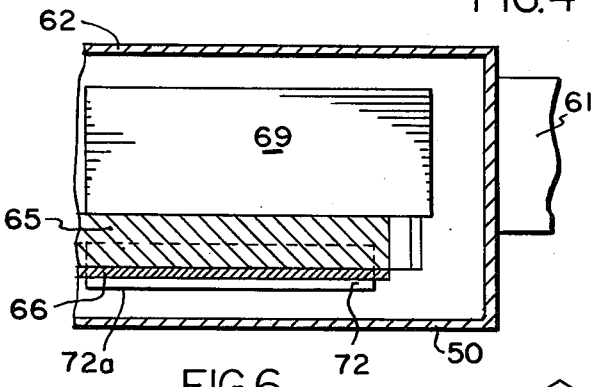
FIG. 6 is a fragmentary, sectional view taken on the line 6—6 of FIG. 4.

The usual chipper blade knives 72 extend rearwardly of the wear plates 66 into alignment with the openings 65*a*, as shown particularly in FIG. 5, and may be mounted in knife holders 72*b* secured to the triangular disc part 65 by way of bolts 73. It is to be understood that a knife blade 72, having a cutting edges 72*a*, is provided to project into alignment with each of the openings 65*a* and that rotation of the shaft 64 and composite disc assembly which it carries, is in the direction indicated by the arrow *d* in FIG. 4. Provided to cooperate with the knives 72, is a stationary anvil 74, which has a vertical edge 74*a.* A support wall 75 is provided as shown in FIG. 1, to mount the anvil 74 in operative position.

The hydraulic system employed for synchronously driving chain 13 and rolls 14, 15, and 16 forwardly or reversely may be the same as shown in U.S. pat. No. 3,661,333.

In operation, whole trees T, including the attached limbs and branches, are placed trunk foremost on the conveyor 13 by a loading crane associated with the machine, which I have not shown in the present drawings. The trees are, of course, extremely heavy and the butt ends of the trunk tend to swing in a horizontal plane as they approach the space between upright posts 27 and 28. The provision of the teeth 31*b* aid the crane operator in placing the butt of the tree in proper position generally centrally on conveyor 13. When the butt end of the tree hits teeth 31*b,* the teeth 31*b* tend to dig into the butt end of the tree and the butt does not simply slide along the back wall 31*a.* The operator can guide the butt end of a tree, which generally is being lifted from a side position relative to the machine and is skewed thereto, into a generally central position on the teeth 31*b* and then with teeth 31*b* penetrating the butt end, the skewed tree can be swung in a horizontal plane about the teeth 31*b* as a pivot into a position of longitudinal alignment with conveyor 13.

The butt end of the tree T enters the space between posts 27 and 28 and engages and pushes the roller 14 upwardly against the bias of cylinder 36. At this time, the conveyor 13 is moving the tree T in the direction *x,* and, as the roller 14 rides up over the end of the butt of the trunk, it (because of its rotation in the direction *a*) also tends to move the tree T forwardly. Thereafter, the roller 15 engages the trunk, or branches growing from the trunk, and tends, because of its rotation in the direction *b,* to also move the tree toward the chipper opening O. Finally, the side roll 16, because of its rotation in the direction *c,* also engages the tree or its branches and assists in moving it into the chipper opening O in a continuous manner.

As the tree T is fed forwardly, the rotation of chipper disc 65 is such as to continuously take a cut of, for example, ⅞th inch off the butt end of the tree with each pass of a chipper knife 72. The layer removed immediately breaks into chips which are accelerated from zero speed to a speed which might typically approach 12,000 feet per minutes, which is a typical knife speed. The chips move at this accelerating speed through the opening 65*a* and into the housing 69. Where, in former machines, they impinged against the stationary back wall of the chipper housing and there was considerable wear of the chipper housing back plate as a result, the wear factor is greatly reduced because housings 69 travel with the disc part 65. Moreover, because the housings 69 are of increasing girth, chips do not tend to bridge in housings 69 and instead are hurled as a mass spout 61 at the time each housing 69 approaches alignment with spout 61. The chips, in other words, gather or collect in the housings 69, and at the time the reach the position of alignment with spout 61, they are hurled out the spout 61 at an extremely high rate of speed. Spout 61, of course, connects with a spout extension which may feed the chips into a railroad car, truck, or the like. Because the chips cut with each pass are hurled as a collected mass, there is no problem with breakage due to contact with fan blades, or the like, as in some prior machines. In the present instance, the centrifugal force of the rapidly rotating disc assembly is utilized to hurl the mass and, because of the constant growth or taper of the walls 69*a* of housings 69 in an outward direction, no wedging of the chips occurs in the housing. Typical thicknesses of wear plates 66 and disc part 65 are ¾ of an inch and 4 inches respectively.

The chain 13 centers on the chipper opening O and as previously, vanes 146 tend to laterally center the material being fed toward the chipper housing C. Particularly when the upper portion of the tree is all that remains and mainly limbs and branches are being fed, the vanes 146 are valuable in maintaining the remaining portions of the tree centrally disposed as they are fed toward the chipper opening O. The powered serrated teeth 46 and 60 are also particularly valuable because they engage the limbs and branches and move them forwardly, the teeth providing purchase and gripping surfaces which a smooth roll simply would not do.

If a tree with a forked trunk is moving forwardly on the live bed 13, and one of the forked portions of the trunk engages the spiral vane 58 on roll 15, the vane 58 will tend to lift the forked portion and rotate the tree T about its axis just sufficiently so that it fits diagonally through the opening O with the greatest width of the tree substantially aligned with the longest cross dimension of opening O.

The unique chain construction utilized in the live bed 13 has a number of advantages for the type of work contemplated. The large surface pads or plates 21, for instance provide a large contact surface and further provide enough sharp edge surface to do a very good job of advancing the tree. The chain is hard to damage with the loader grapple, and there are no fatigue loaded pins as with some prior constructions.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

I claim:

1. In a machinery for reducing forest products to wood chips:

a chipper disc assembly having a front face and a rear face and at least one opening therein leading from the rear face to the front face;

means for rotating said disc assembly in the direction of rotation at a chip cutting speed;

a feed mechanism for moving the said products to the rear face of said disc assembly comprising: a longitudinally disposed live feed bed to which said disc assembly is angularly disposed; a top roll crosswisely disposed to the live feed bed and vertically movable to crush limbs down to the trunk of a tree being fed toward the rear face of the chipper disc assembly; generally vertically disposed side guides having tree engaging surfaces thereon disposed downstream of said roll; at least one of said side guides comprising roll with vane means thereon for revolving a forked tree partly about its axis; and means for revolving said rolls and live bed at coordinated tree feeding speeds in directions of rotation to move a tree toward the chipper disc assembly;

a disc assembly housing including a rear wall with an opening to admit said products, a front wall, and a perimetral wall with an opening to egress chips; and disc knife blade means for said opening positioned to cut said products with rotation of said disc assembly into chips and propel them through said opening forwardly.

2. The machinery as set forth in claim 1 in which said chipper disc assembly is situated at a skew angle with respect to the longitudinal extent of the live feed bed and has an upstream edge and a downstream edge, and said roll with the vane means is adjacent the upstream edge; the vane means comprising a helical vane extending from the bottom of the roll to a point about midway of the height thereof.

3. In a machinery for reducing forest products to wood chips:

a chipper disc assembly having a front face and a rear face and at least one opening therein leading from the rear face to the front face;

means for rotating said disc assembly in a direction of rotation at a chip cutting speed;

a feed mechanism for moving the said products to the front face of said disc assembly comprising: a longitudinally disposed live feed bed to which said disc assembly is angularly disposed; a top roll crosswisely disposed to the live feed bed and vertically movable to crush limbs down to the trunk of a tree being fed toward the rear face of the chipper disc assembly; generally vertically disposed side guides having tree engaging surfaces thereon disposed downstream of said roll; and means for revolving said rolls and live bed at coordinated tree feeding speeds in directions of rotation to move a tree toward the chipper disc assembly;

laterally spaced teeth means stationarily positioned upstream of said top roll a spaced distance above said live feed bed against which a tree butt may be engaged to aid in positioning the tree centrally on the live bed;

a disc assembly housing including a rear wall with an opening to admit said products, a front wall, and a perimentral wall with an opening to egress chips; and disc knife blade means for said opening positioned to cut said products with rotation of said disc assembly into chips and propel them through said opening in the disc assembly.

4. In machinery for reducing forest products to wood chips;

a chipper disc assembly comprising: a generally triangular heavy flywheel disc part with spaced apices, having reduced thickness circular segment plates attached thereto as wear plates, said assembly having a front face and a rear face and at least one opening therein leading from the rear face to the front face of the flywheel disc part;

means for rotating said disc assembly in a direction of rotation at a chip cutting speed;

a feed mechanism for moving the said products to the disc assembly;

a disc assembly housing including a rear wall with an opening to admit said products, a front wall, and a perimetral wall with an opening to egress chips; and disc knife blade means for said opening positioned on the flywheel disc part to cut said products with rotation of said disc assembly into chips and propel them forwardly through said opening.

5. In machinery for reducing forest products to wood chips;

a chipper disc assembly comprising a generally polygonal heavy flywhel disc part with spaced corners having reduced thickness circular segment plates attached thereto to bridge the corners thereof, said assembly having a front face and a rear face, and at least one opening therein leading from the rear face to the front face of the flywheel disc part;

means for rotating said disc assembly in a direction of rotation at a chip cutting speed;

a feed mechanism for moving the said products to the rear face of said disc assembly;

a disc assembly housing including a rear wall with an opening to admit said products, a front wall, and a perimetral wall with an opening to egress chips;

disc knife blade means fixedly mounted within said opening in the heavy disc part and projecting from the rear face of said disc assembly to cut said products into chips and propel them forwardly through said opening with rotation of said disc assembly, said feed mechanism comprising a longitudinally disposed live bed to which said disc assembly is angularly disposed; a top roll is crosswisely disposed to the live feed bed and vertically movable to crush limbs down to the trunk of a tree being fed toward the front face of the chipper disc assembly; generally vertically disposed side rolls having tree engaging surfaces thereon are disposed downstream of the said roll and laterally inbored of the ends thereof, and one of said rolls has helical vane means thereon for revolving a forked tree partly about its axis to permit it to move easily into the chipper housing opening; and means is provided for revolving the rolls and live bed at coordinated tree feeding speeds in directions of rotation to move a tree toward the chipper disc housing.

6. The machinery as set forth in claim 5 wherein the chipper disc assembly is situated at a skew angle with respect to the longitudinal extent of the live feed bed and has a rearward edge and a forward edge, and said roll with the helical vane means thereon is positioned at the rearward edge of said disc assembly housing.

7. The machinery as set forth in claim 5 in which trunk butt penetrating teeth are mounted forwardly of said top roll to aid a crane operator in positioning the tree on the live bed in longitudinal alignment with it.

8. The machinery as set forth in claim 7 wherein a top roll frame mounts said top roll for vertical swinging movement and has a rearwardly disposed end face, said trunk butt penetrating teeth being fixed on said rearwardly disposed face.

* * * * *

UNITED STATES PATENT AND TRADEMARK OFFICE

CERTIFICATE OF CORRECTION

PATENT NO. : 4,057,192

DATED : November 8, 1977

INVENTOR(S) : Leward N. Smith

It is certified that error appears in the above-identified patent and that said Letters Patent are hereby corrected as shown below:

Column 2, line 53, cancel "is"

Column 3, line 9, change "bearing" to --bearings--

Column 3, line 39, after "35b" insert --,--

Column 4, line 13, change "part drum" to --drum part--

Column 4, line 68, change "edges" to --edge--

Column 5, line 20, change "aid" to --aids--

Column 5, line 51, after "breaks" insert --up--

Column 5, line 62, after "mass" insert --out--

Column 5, line 65, change "the" second occurrence to --they--

Column 6, line 13, change "146" to --14b--

UNITED STATES PATENT AND TRADEMARK OFFICE

CERTIFICATE OF CORRECTION

PATENT NO. : 4,057,192

DATED : November 8, 1977

INVENTOR(S) : Leward N. Smith

It is certified that error appears in the above-identified patent and that said Letters Patent are hereby corrected as shown below:

Column 6, line 17, change "146" to --14b--

Column 6, line 54, change "the" to --a--

Column 6, line 66, after "comprising" insert --a--

Column 7, line 45, change "perimentral" to --perimetral--

Column 7, line 51, change ";" to --:--

Column 8, line 11, change ";" to --:--

Column 8, line 13, change "flywhel" to --flywheel--

Signed and Sealed this

*Twenty-fifth* Day of *April 1978*

[SEAL]

*Attest:*

RUTH C. MASON
*Attesting Officer*

LUTRELLE F. PARKER
*Acting Commissioner of Patents and Trademarks*